US009708036B2

(12) United States Patent
Ries

(10) Patent No.: US 9,708,036 B2
(45) Date of Patent: Jul. 18, 2017

(54) ANCHORING APPARATUS

(71) Applicant: Thomas Frank Ries, Lutz, FL (US)

(72) Inventor: Thomas Frank Ries, Lutz, FL (US)

( * ) Notice: Subject to any disclaimer, the term of this patent is extended or adjusted under 35 U.S.C. 154(b) by 42 days.

(21) Appl. No.: 14/544,412

(22) Filed: Jan. 5, 2015

(65) Prior Publication Data

US 2016/0194058 A1 Jul. 7, 2016

(51) Int. Cl.

| | |
|---|---|
| ***B63B 22/00*** | (2006.01) |
| ***B63B 21/20*** | (2006.01) |
| ***B63B 22/04*** | (2006.01) |
| *B63B 21/22* | (2006.01) |

(52) U.S. Cl.

CPC ..... *B63B 22/00* (2013.01); *B63B 21/20* (2013.01); *B63B 22/04* (2013.01); *B63B 2021/225* (2013.01)

(58) Field of Classification Search

CPC ..... B63C 9/082; B63B 22/00; B63B 21/22; B63B 2021/222; B63B 2021/225

USPC ..... 441/3, 6, 81; 114/294–311

See application file for complete search history.

(56) References Cited

U.S. PATENT DOCUMENTS

| | | | | | |
|---|---|---|---|---|---|
| 715,261 | A * | 12/1902 | Hamilton | B63C 9/082 | 441/81 |
| 4,063,323 | A | 12/1977 | Salvarezza | | |
| 4,416,640 | A | 11/1983 | Eickenhorst | | |
| 4,449,947 | A * | 5/1984 | Brault | B63C 9/082 | 441/81 |
| 4,549,871 | A * | 10/1985 | Verney | B63C 9/082 | 441/81 |
| 5,273,468 | A * | 12/1993 | Nichols | B63B 22/08 | 441/26 |
| 5,342,229 | A * | 8/1994 | Whitt | B63B 22/18 | 114/294 |
| 5,433,637 | A * | 7/1995 | Graves | A63H 33/18 | 441/80 |
| 5,516,316 | A * | 5/1996 | Rumminger | B63C 11/26 | 441/1 |
| 5,613,888 | A * | 3/1997 | Lamphere | A01K 93/00 | 441/23 |
| 6,067,924 | A * | 5/2000 | Chatelain | B63B 21/22 | 114/210 |
| 7,311,575 | B1 * | 12/2007 | Briles | A01K 93/02 | 441/13 |
| 7,699,676 | B2 * | 4/2010 | Nicholson | B63B 22/04 | 441/28 |
| 7,722,419 | B1 * | 5/2010 | Wood | B63C 11/02 | 441/40 |
| 8,485,856 | B2 * | 7/2013 | Paternostro | A01M 31/06 | 114/293 |

* cited by examiner

*Primary Examiner* — Joshua Kennedy

(57) ABSTRACT

To make secondary anchoring of small boats quick, safe, versatile, a low cost buoyant apparatus with an attached tripping strap has been invented to permit transport of a secondary anchor to its holding location. The invention, in addition serves to prevent excessive boat swings once anchored in restricted anchorage, and can also serve as a marker in the event that an earlier anchored boat needs to move and return to the same spot. This buoyant apparatus is very versatile; it can be used from the boat's bow, from the stern, and also as a lunch hook. Although the buoyant ring has an appearance of a life preserver, it is not intended for that use, and does not qualify as U.S. Coast Guard or Sheriff Regulation safety equipment.

5 Claims, 8 Drawing Sheets

ANCHORING APPARATUS

CROSS-REFERENCE TO RELATED APPLICATIONS

Provisional Patent Application No. 61/965,000 filed Jan. 22, 2014. Title: Process and Apparatus for Alternate Anchoring of a Boat.

Non-provisional Design Patent Application No. 29/463,614 filed Jan. 22, 2014. Title: Anchor Float.

STATEMENT REGARDING FEDERALLY SPONSORED RESEARCH OR DEVELOPMENT

Not applicable.

REFERENCE TO SEQUENCE LISTINGS, ETC.

Not applicable.

BACKGROUND OF THE INVENTION

The traditional way of anchoring a boat is to drop a single anchor from the bow and drift or power the boat backwards. In this position the boat can swing side-to-side depending on wind and wave conditions. In some cases, the anchor can be dropped from the stern and the boat powered forward. This latter stern anchoring is generally not done on large vessels because it can be unsafe under some weather and traffic conditions. However, it is very commonly used for small boats in the 16' to 22' range for temporary anchoring. In either case, the boat swings side-to-side is similar but not the same amount.

The boat anchor is usually sized to the boat length and has a length of chain to insure the anchor will properly set in the bottom when launched. The anchor size is a combination of weight and shape depending on the size of the boat. The intent of the anchor is to hold the boat in all weather conditions.

For temporary large boat anchoring, a "lunch hook" is usually used. This is a very light weight anchor. This lunch hook anchor can also be used at the bow in place of the main boat anchor or as an additional anchor launched from the stern when the main boat anchor is used at the bow. This light weight lunch hook or secondary anchor is used to steady the boat swings under certain conditions.

Small boats however, use the same anchoring methods as explained for the larger vessels. However everything is scaled down because of the vessel size and on board space. Therefore small boats usually use lighter type anchors with shorter chain to insure proper holding at the bottom. In the case of the secondary anchoring, here the tackle gets much lighter, makes use of fluke-type anchors, without chain, and light weight anchor line or rode.

In shallow waters along the shore lines of waterways and lakes, beaching a small boat is very common. For example, one is to use a short seine type net to catch bait-size fish for sale or chumming. A second is to have beach parties to let their children play in the sand. A third is to give boater dogs a dry beach run. A fourth might be to cook up a BBQ meal. Examples are endless for recreational and commercial vessels alike. It is in these cases where a secondary anchor is the most frequent situation that is encountered. However in all cases, the secondary anchoring must be made rather quickly, be flexible and without complications that is normally seen with the larger boat anchors.

Several situations arise that can cause problems with single anchoring when a second anchor is required. This is because it becomes difficult to launch a second anchor when boat swings must be restricted. This becomes obvious in shallow beach waters, tight fishing areas, or in narrow or restricted boat anchoring areas. In other cases, walking the second anchor to set it can be difficult, dangerous and/or unsafe for the boat as well as its passengers.

What can become dangerous to a person, particularly in shallow waters, is the bottom waters may be unpredictable and not too clear. Water bottoms may contain irregular holes, ledges, sharp shells, and rocks covered by slippery grass, all or any one can easily cause a person to get hurt when carrying a secondary anchor to shore.

On the other hand, some shore landings can become uncomfortable due to wave action from passing vessels or wind changes, requiring an additional anchor to be set. In other cases to fix the movement of side-to-side motion an additional anchor has to be set. In these situations, carrying the anchor to the shore can be dangerous due to unpredictable movement of the boat.

To make secondary anchoring of small boats quick, safe, versatile, a low cost buoyant ring has been invented to transport the secondary anchor to its holding location. The invention features a buoyant ring with indents to hold the secondary anchor temporarily in place during its movement. The invention, in addition serves to prevent excessive boat swings once anchored in restricted anchorage, can also serve as a marker in the event that an earlier anchored boat needs to move and return to the same spot. This buoyant ring is very versatile; it can be used from the boat bow, from the stern, and also as a lunch hook. Although the buoyant ring has an appearance of a life preserver, it is not intended for that use, and does not qualify as U.S. Coast Guard or Sheriff safety equipment.

BRIEF SUMMARY OF THE INVENTION

The invention buoyant ring makes use of an attached short tripping strap, as shown in the FIG. 1. The anchor and its line are for illustration only, and are not the invention. However they are used in the operation of the anchoring.

The buoyant ring facilitates the movement of efficient ground tackle, such as a light weight fluke-type anchor, chain free, to the selected anchoring location. Trade names for these aluminum or steel anchors are: Danforth, Fortress, Guardian, Hooker, with or without a slip ring shank. These anchors are very common and lightest type to transport on the floating ring, but other type anchors may be used with a modified float.

The buoyant ring in FIG. 1 makes use of indents on the top side of the float to hold the secondary anchor in place during transport to a specific location.

The attaching secondary anchor line or rode is used with the invention, is usually in shorter lengths, say 25' to 50'. The line size and length can vary according to the boat length, its freeboard and depth of the water. In addition, the buoyant ring maybe brightly colored with reflective material, and labeled with caution wording, so it can easily be seen once the anchor is launched into the water. The tripping strap is looped around to the anchor line and is used to "dump" the anchor into the water when the line is pulled. The pull on the anchor line transmits to the strap; this jerking of the line takes place at the designated anchoring location. This upsetting turns the float over to reveal the caution message on the underside of the float. The float ring connection to the anchor line permits it to slide and surface over the approximate anchor setting to mark the location.

DETAILED DESCRIPTION OF USING THE INVENTION

Figure 1:
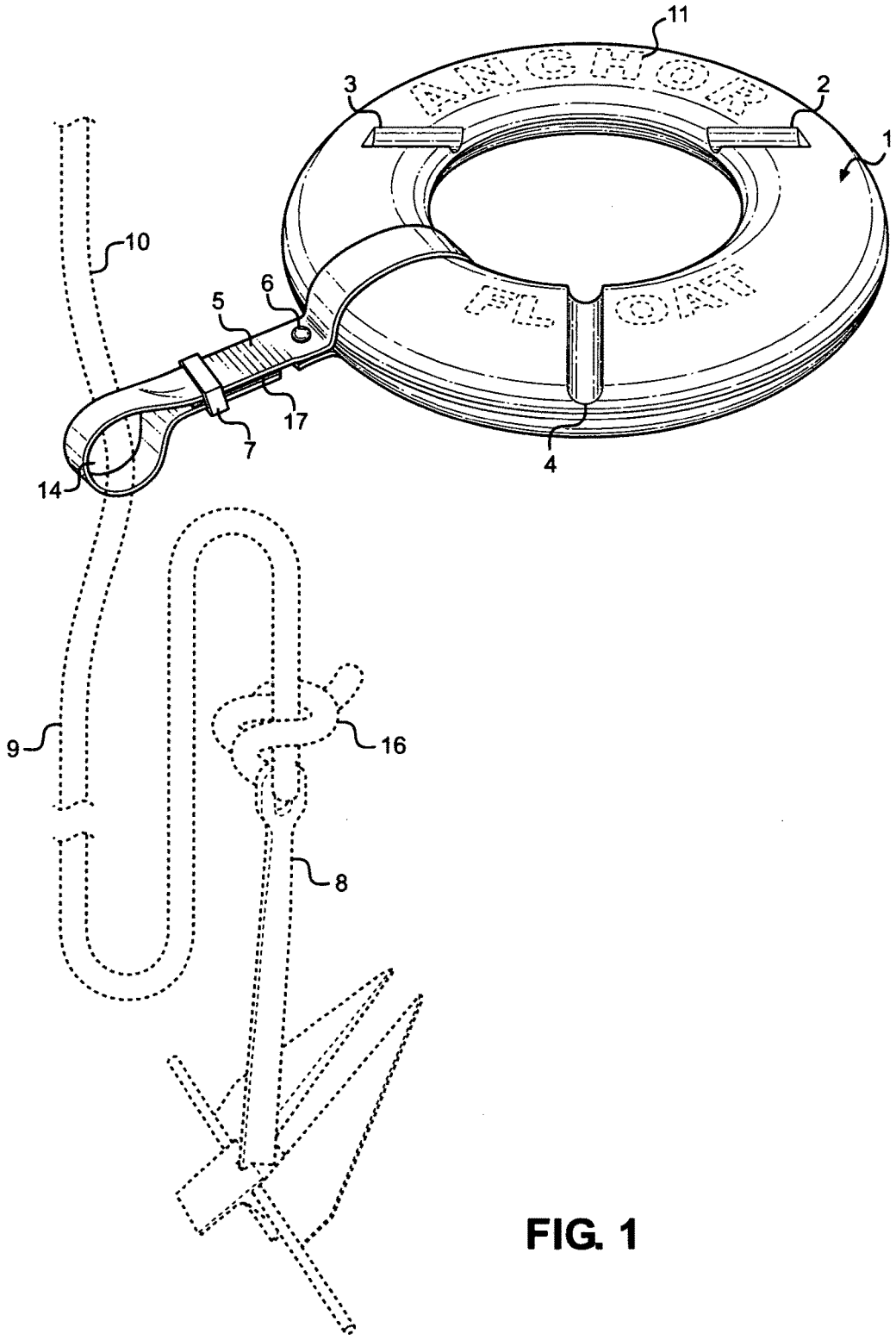
FIG. 1 is a Perspective View showing the invention which is a two sided buoyant ring 1, one of which is the top side having 3 indentations for the anchor, a right stock indent 2, a left stock indent 3, and a shank indent 4, with a topside as shown, with a displayed name "Anchor Float" 11, along with a tripping strap 5, secured to the ring 1 by a rivet 6, with an adjustable slide 7 after the lower end of the strap 5 is positioned and locked between the male and female Velcro® 17 to determine the correct size of the strap loop 14 which trips the fluke anchor 8, connected to a line or rode 9, secured to a fluke anchor 8, fastened to an anchor rode 9 by a knot 16, continuing onto the boat rode 10.
Figure 2:
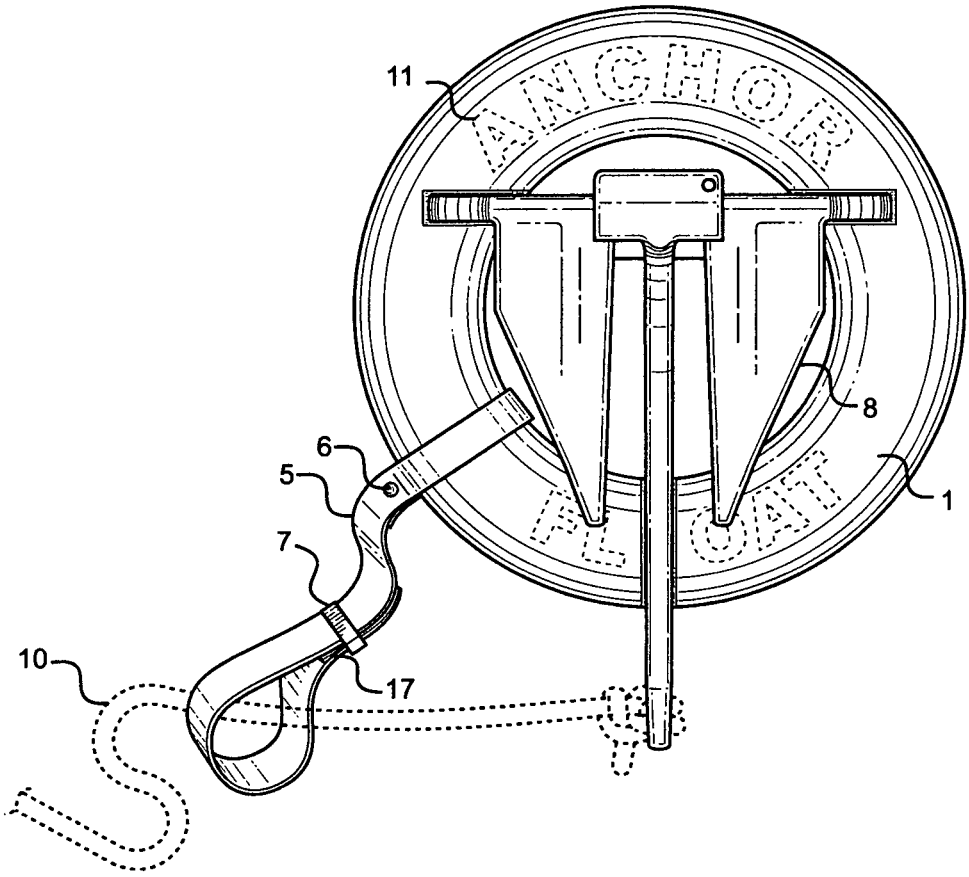
FIG. 2 is a Top View of the fluke anchor 8 in place on top of the buoyant ring 1, noted by the displayed name "Anchor Float" 11, and the tripping strap 5 secured in place by rivet 6, as well as the VELCRO® 17 and slide 7, attached to the rode 10.
Figure 3:
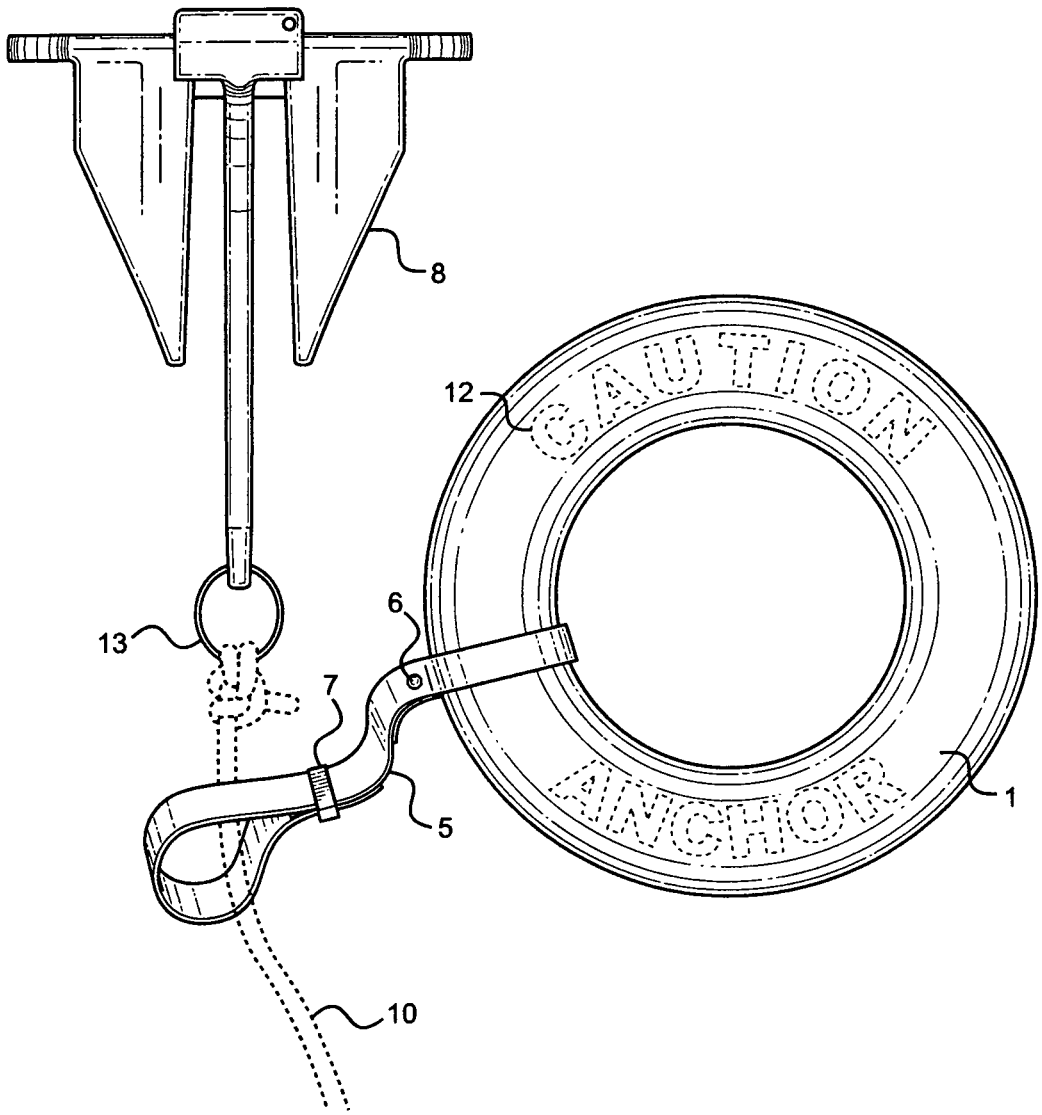
FIG. 3 is a Bottom View of the buoyant ring 1, showing the safety message "Caution Anchor" display 12, when launched fluke anchor 8 displaced by the tripping strap 5, secured in place by rivet 6 and strap slide 7, with rode 10 attached in this case to an alternate anchor ring 13.
Figure 4A:
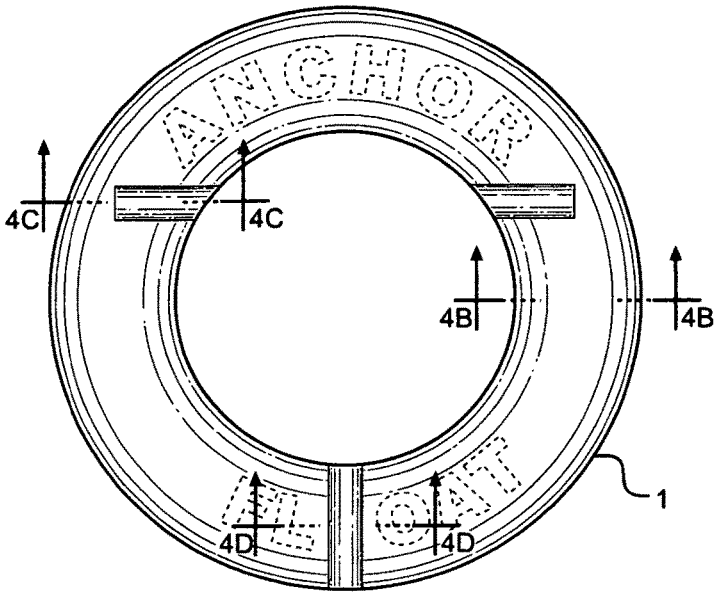
FIG. 4A shows a Top View of the buoyant ring 1 shown in FIG. 2, with three indentation Charlie cross-sections FIG. 4B, FIG. 4C, and FIG. 4D.
Figure 4B:
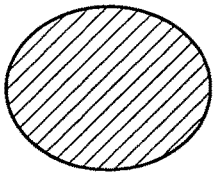
Figure 4C:
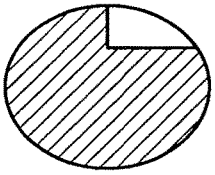
Figure 4D:
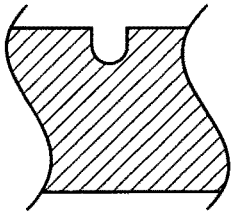
Figure 5:
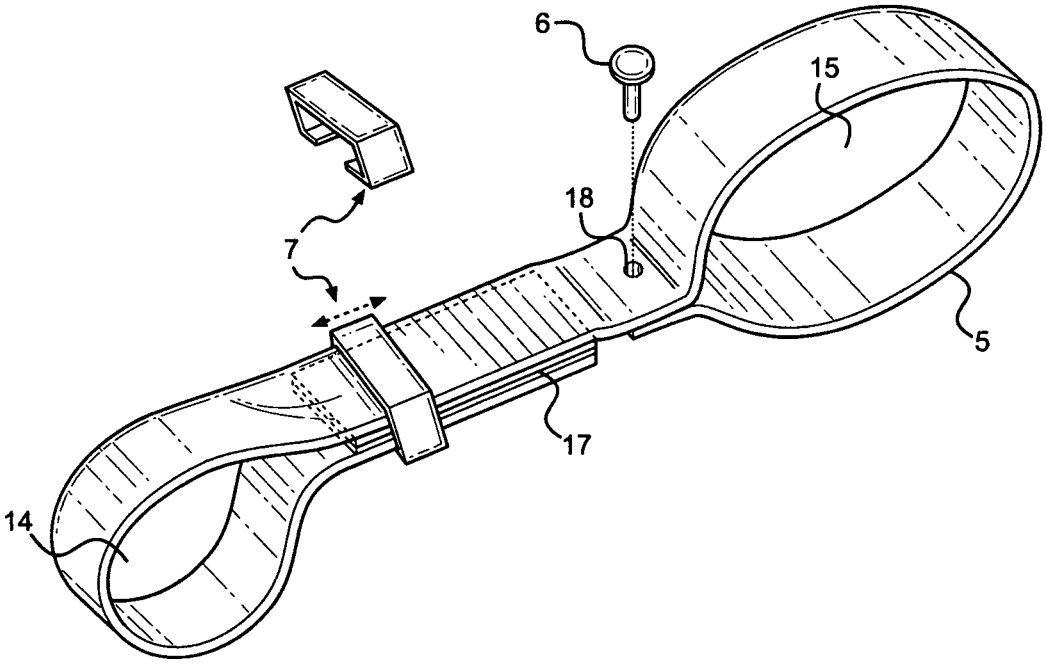
FIG. 5 is an enlarged Perspective View showing the details of the tripping strap 5 with the buoyant ring loop 15 secured in place by the rivet 6 into the hole 18, and the rode loop 14 sized by shifting the male and female Velcro® 17 fore and aft and pressed in place by locking slide 7.
Figure 6:
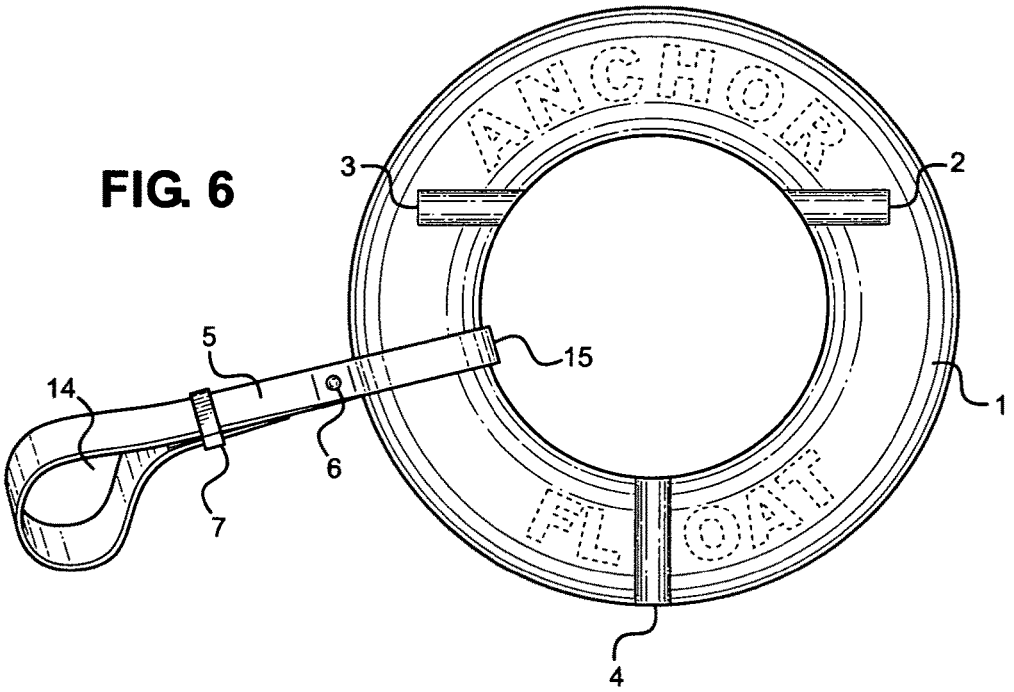
FIG. 6 is a Top View and FIG. 7 is a Bottom View comparison between the FIG. 6 and FIG. 7 of the buoyant ring 1 showing the different name and safety message, along with the indents 2, 3, and 4 as well as the position of the tripping strap 5, rivet 6, slide 7, and loops 14 and 15.
Figure 7:
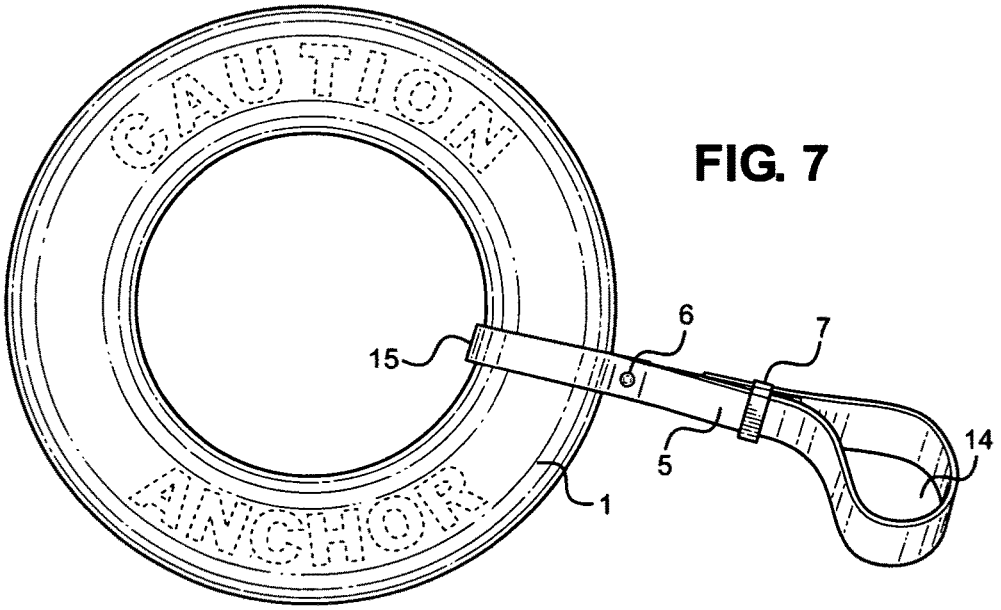
Figure 8:
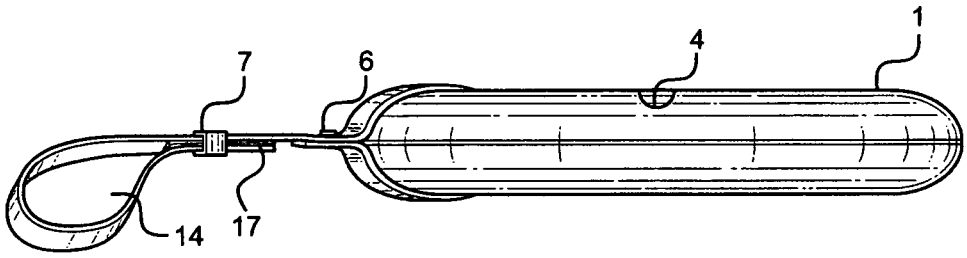
FIG. 8 is a Front View and FIG. 9 is a Back View comparison between the FIG. 8 and the FIG. 9 of the buoyant ring 1 and strap 5, as well as indent 4, rivet 6, slide 7, Velcro® 17 and loops 14 and 15.
Figure 9:
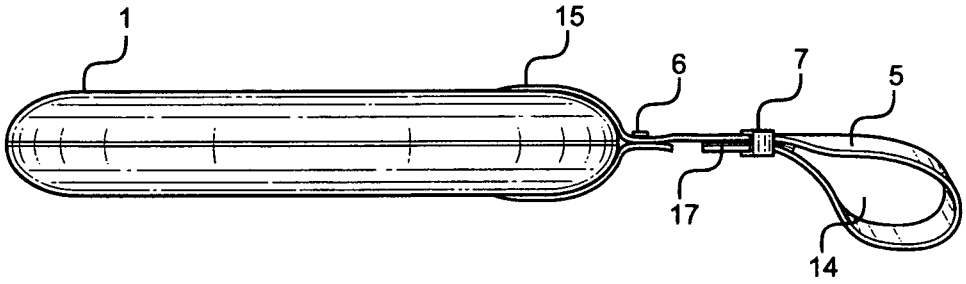
Figure 10:
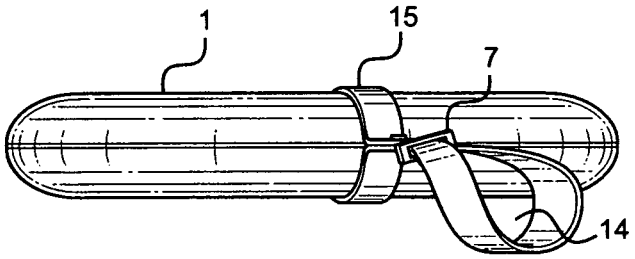
FIG. 10 is a Left Side View and FIG. 11 is a Right Side View comparison between the FIG. 10 and the FIG. 11 of the buoyant ring 1, strap lock 7, loop 14 and loop 15.
Figure 11:
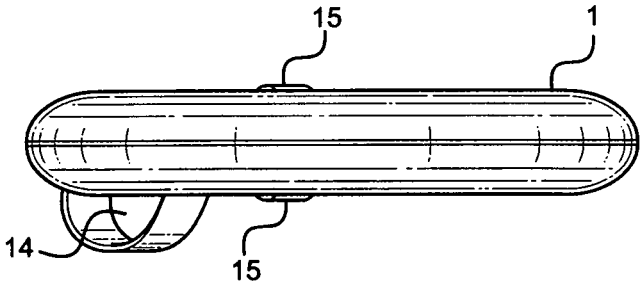

The correct size light weigh fluke anchor is placed on to the buoyant ring top in the indented resting position. The fluke anchor line is threaded through the tripping strap loop. The line is then coiled around the left hand of the on board individual, after which the right hand swings the ring assembly off the boat and into the water. The casting technique is easily acquired with a few practice casts on a flat lawn area. This technique is much easier than casting the light weight fluke anchor by it's self due to anchor shape and flex shielding.

Once the ring and fluke anchor are floated into position, the fluke anchor can be removed from the buoyant ring by hand, and dropping the anchor to the bottom sediment. The fluke anchor can also be jerked from the boat to dislodge it from the ring, allowing the anchor to naturally sink into position. The buoyant ring then floats along the anchor rode to mark the anchor's position. The ring is self-adjusting so that it can be positioned anywhere along the anchor rode to mark the anchor line's location or the actual position of the anchor itself. This feature allows for easy retrieval, when leaving an anchor and line in place, for mooring purposes.

To summarize, there are three ways the invention can be used. They follow as Numbers 1, 2 and 3.

Number 1—The regular boat bow anchor is not used. The buoyant ring with the fluke anchor in place can be used as a temporary hook for lunch by casting it off the bow, "floated" to a decided location, quickly pulling on the rode, to flip the fluke anchor into the water, and settle to the bottom. The float then centers on the in-water anchor rode, to "caution" other boaters of the presence of the anchor and its rode.

Number 2—The regular boat bow anchor is set. The stern of the boat is powered or drifts towards the shore. The float with the secondary fluke anchor on top is cast flat or dropped at the stern of the boat to drift towards the shore. When the anchoring position is reached, the fluke rode is pulled, and the ring flips over, dropping the fluke into the water and settling it into the bottom.

In shallower shoreline waters, the float ring, with the secondary fluke anchor on top, can be used by the boat operator to float the anchor to shore. Once this secondary anchor is set, the float is positioned right over float over the secured anchor, with the caution lettering facing up, to warn beachcombers of the presence of the anchor, for safety purposes.

When the boat is about to leave this location, the boat operator can then set the anchor on top of the float for easy transport back to the boat.

Number 3—On occasions, a mooring location is desired for return trips to the same anchor location. The buoyant ring can also be used to serve as a temporary mooring marker for easy return. The fluke anchor rode is disconnected from the boat, and the anchor is set at the desired location. The float is flipped over to the caution side to warn other boaters of the presence of an anchor rode. The loose end of the rode is then secured on shore to a fixed object.

Upon return, the boat operator can easily find the previously set anchor and tie off in the same manner as before. This is especially useful when mooring in the same location for an extended period of time (i.e. beach camping, water skiing, etc.), with frequent trips in and out of a desired location; upon return, the boat operator can easily find the previously set anchor, and secure the boat quickly and easily in the same safe anchor location, without having to reset their mooring anchor.

I claim:

1. A floatable apparatus, comprising a ring-shaped float defining a central opening; and a tripping strap having a proximal end secured to the float and an adjustable strap loop arranged on a distal end through which an anchor rode is configured to extend;

the float having a top surface, a bottom surface, a generally convex edge wall that defines the circumferential exterior of the float, and a series of indents on the top surface extending from the central opening, wherein the indents are configured to accommodate a marine fluke anchor; the series of indents comprising:

a right stock indent;

a left stock indent, wherein the right and left stock indents are arranged in a single line on opposing sides of the central opening; and a shank indent arranged perpendicularly to the line defined by the right and left stock indents;

wherein the indents keep the anchor in place during transit to a selected anchoring location, at which time it is upset by an anchor rode and the tripping strap, to drop the anchor into sediment.

2. The floatable apparatus of claim 1, further comprising a rigid plastic material configured to have sufficient density to float the marine fluke anchor and line during periods of transit over the water.

3. The floatable apparatus of claim 2, having a smooth surface configured to permit the fluke anchor to release and slide smoothly into the water without hanging up when upset by the tripping lever.

4. The floatable apparatus of claim 1, wherein the tripping strap can be adjusted so that the floatable apparatus can be secure directly above the marine anchor fluke to signal that an anchor is located below; for safety purposes.

5. The floatable apparatus of claim 1, wherein the adjustable strap loop comprises a hook and loop fastener fixed in place by a securing locking slide.

* * * * *